US005417011A

United States Patent [19]

Keszthelyi

[11] Patent Number: 5,417,011

[45] Date of Patent: May 23, 1995

[54] DOOR OPENING MECHANISM

[76] Inventor: Laszlo Keszthelyi, 8-03 117 St., Colleg Point, N.Y. 11356

[21] Appl. No.: 200,158

[22] Filed: Feb. 23, 1994

[51] Int. Cl.[6] ..... E05F 15/02

[52] U.S. Cl. ..... 49/334; 49/28

[58] Field of Search ..... 49/28, 26, 334, 324

[56] References Cited

U.S. PATENT DOCUMENTS

| | | | |
|---|---|---|---|
| 3,195,879 | 7/1965 | Bond et al. | 49/28 X |
| 3,276,164 | 10/1966 | Hilfing et al. | 49/28 |
| 3,864,875 | 2/1975 | Hewitt | 49/334 X |
| 3,916,567 | 11/1975 | Daugirdas | 49/28 |
| 3,940,887 | 3/1976 | Slaybaugh | 49/334 X |
| 4,523,513 | 6/1985 | Gudat et al. | 49/28 |

*Primary Examiner*—Philip C. Kannan

*Attorney, Agent, or Firm*—Howard C. Miskin

[57] ABSTRACT

A swinging door operating mechanism includes a hydraulic cylinder having a piston coupled to the door to open the door with the piston advance, opposite ends of the cylinder being connected through a solenoid actuated four way reversing valve to the input and output respectively of an electric motor driven hydraulic pump. A pressure responsive switch is exposed to the hydraulic fluid delivered to the door opening end of the cylinder and is actuated when the pressure exceeds an adjustable value to deenergize the pump motor and switch the advancing end of the cylinder to the pump inlet. The door opening cycle is initiated by the momentary local or remote closing of a start switch. The cylinder piston is connected to the door by a one way advancing linear to rotary motion coupling.

14 Claims, 4 Drawing Sheets

DOOR OPENING MECHANISM

BACKGROUND OF THE INVENTION

The present invention relates generally to improvements in automatic door operating mechanisms and it relates particularly to an improved automatic swinging door operating mechanism.

It is a conventional practice to effect the automatic opening of a door in response to the depression of a push button or to a remotely generated signal from a motion or object detecting device or the like in the case of a swinging door an opening torque is applied to the door and in order for such torque to reasonably rapidly open the door it is so great that be can be caused to anyone in the path of the opening door. On the other hand, if the applied torque is sufficiently low to minimize the likelihood of harm or damage to anyone stuck by the door, the door opening speed is excessively low. At any rate the operating parameters of the opening door is at best a poor compromise.

SUMMARY OF THE INVENTION

It is a principal object or the present invention to provide an improved door operating mechanism.

A further object of the present invention is to provide an improved swinging door automatic opening device.

Still a further object of the present invention is to provide a safety controlled swinging door automatic opening device in which possible harm or damage to the person is minimized.

Another object of the present invention is to provide an improved mechanism the above nature which is rapid and efficient in operation, tamper proof and highly vandal resistant, rugged and reliable and overcomes the disadvantages and drawbacks of the earlier mechanisms.

The above and other objects of the present invention will become apparent from a reading of the following description taken in conjunction with the accompanying drawings which illustrate a preferred embodiment thereof A mechanism in accordance with the present invention for controlling and automatically opening a swinging door includes a hydraulic motor drive coupled to the door for supplying an opening torque to the door and control means responsive to the opening torque applied to the door exceeding a predetermined value for discontinuing the application of the door opening torque.

In its preferred form the hydraulic motor is a cylinder having a reciprocable piston and piston advancing and retracting ends with respective opposite drive and discharge ports respectively. The ports alternatively communicate through a solenoid actuated four way reversing valve to the pressurized fluid output of an electric motor driven hydraulic pump and by way of a fluid reservoir to the pump input respectively or alternatively to the pump input and output respectively. The control means includes an adjustable switch responsive to the pump output pressure which upon such pressure exceeding an adjustable value deenergizes the electric drive motor and deactuates the valve solenoid to connect the cylinder drive and discharge ports to the pump inlet and outlet respectively. The cylinder piston is connected by way of a lost motion linear to rotatable motion drive coupling which permits the manual closing of the swinging door upon full retraction of the piston.

The improved mechanism is safe and efficient, rugged, highly vandal resistant and reliable and of great versatility and adaptability.

DESCRIPTION OF THE PREFERRED EMBODIMENT

Figure 1:
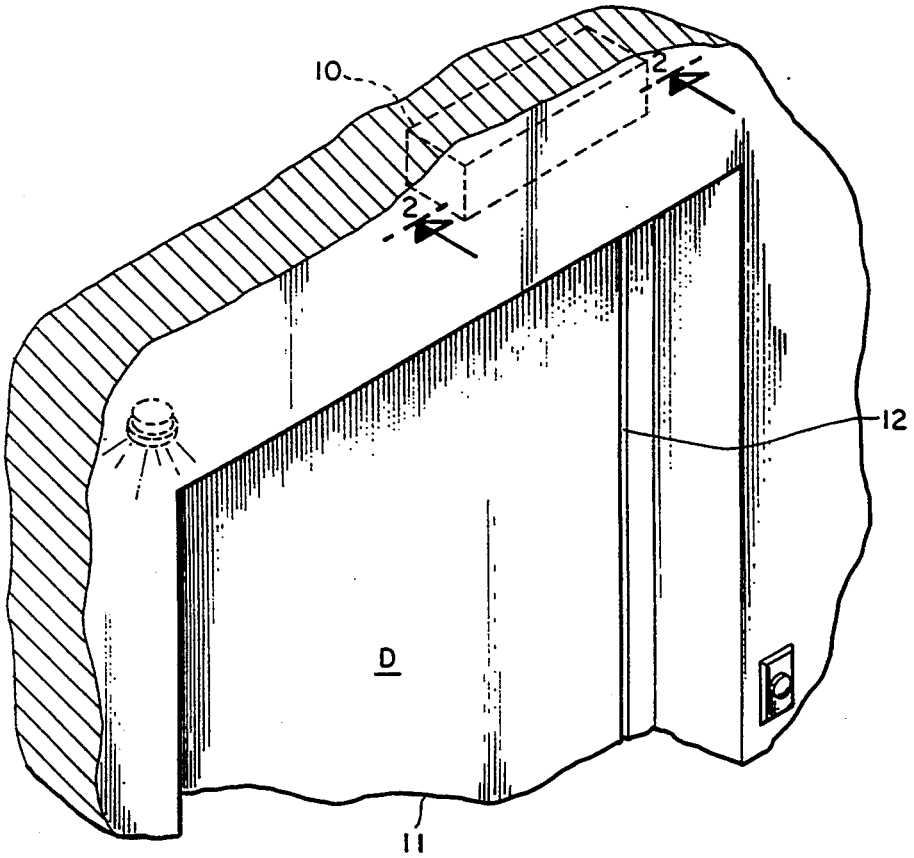
FIG. 1 is a fragmentary perspective view of a swinging door structure employing a door operating mechanism embodying the present invention.
Figure 2:
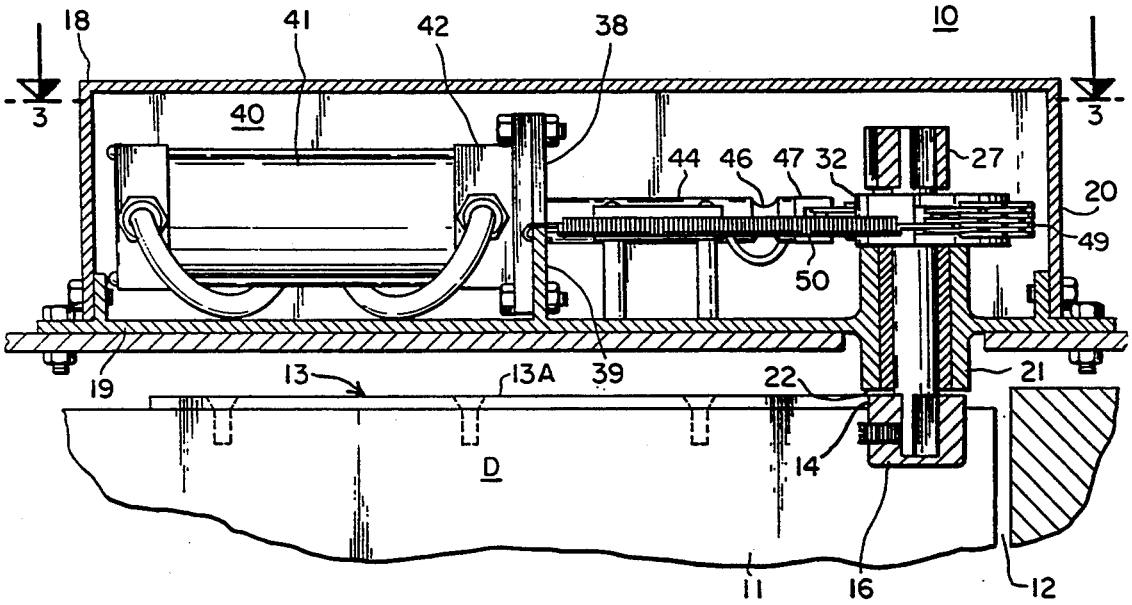
FIG. 2 is an enlarged sectional view taken along line 2—2 in FIG. 1.
Figure 3:
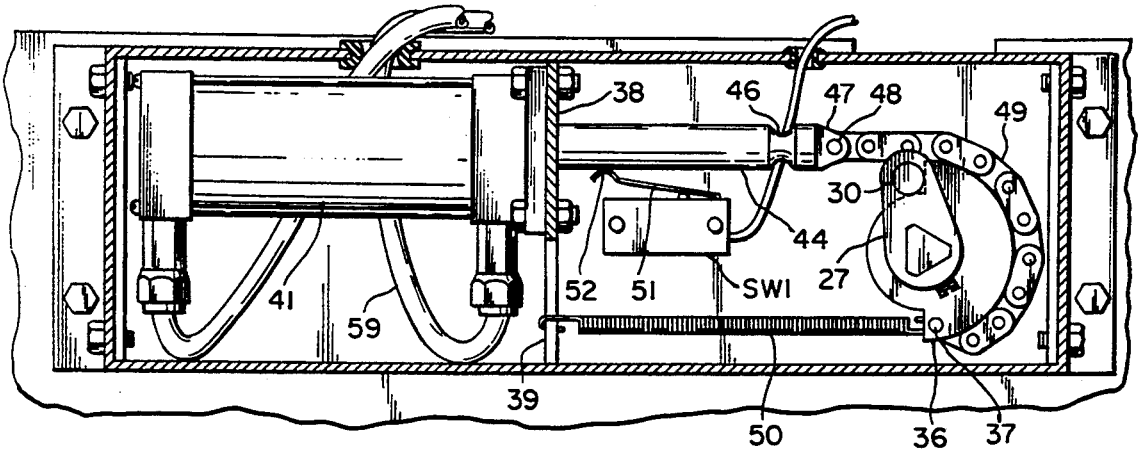
FIG. 3 is a sectional view taken along line 3—3 in FIG. 2.
Figure 4:
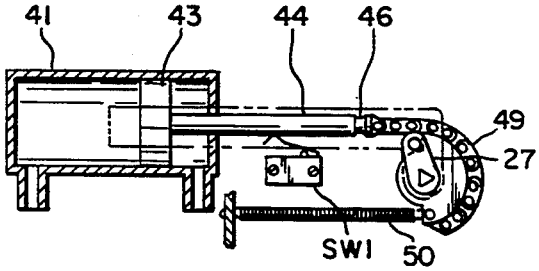
FIGS. 4, 5, and 6 are partial horizontal sectional views of the improved door operating mechanism showing the mechanism successively in a door closed position, a door fully open position, and a door partially open position with the door opening mechanism retracted.
Figure 5:
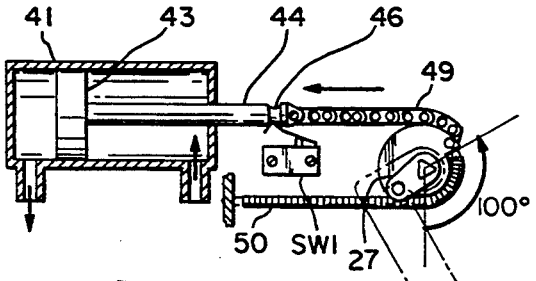
Figure 6:
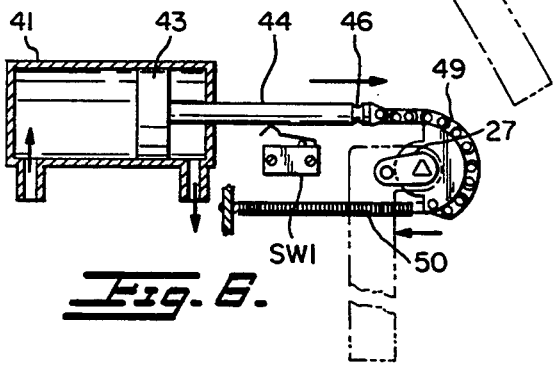
Figure 7:
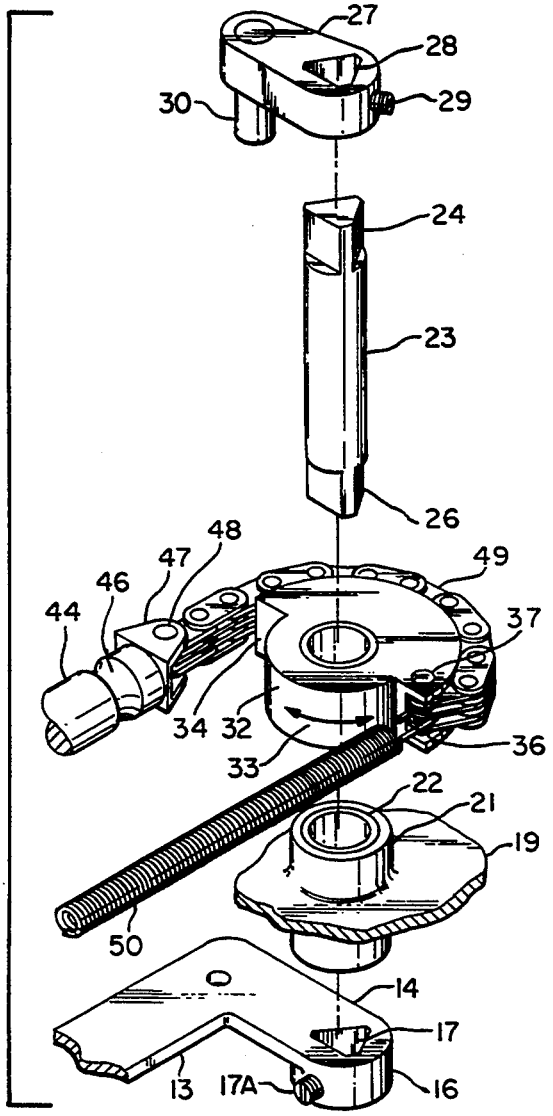
FIG. 7 is an exploded fragmented perspective view of a portion of the door operating mechanism.

Referring now to the drawings which illustrate a preferred embodiment of the present invention, the reference numeral 10 generally designates the improved mechanism shown in operational association with a swinging door 11. Door 11 is rectangular and registers with a mating door opening 12 and is pivotably supported for swinging about a vertical axis proximate and forward of a side edge of door 11 between a closed position in closing engagement with the door opening and a fully 120° open position.

A flat horizontal L-shaped bracket 12 includes a long leg 13 screw secured to the top face of door 11 proximate its pivoted edge and a short leg 14 having formed proximate its free end a depending cylindrical shaft coupling 16 having and axial bore 17 of triangular transverse section and a radial set screw engaging a tapped radial bore in coupling 16.

A housing 18 enclosing the door opening mechanism includes a base plate 19 bolted to the top leg of the door frame and a removable cover shell 20. Integrally formed with and extending vertically through base plate 19 coaxial with the door swing axis is a tubular section 21 internally lined with a bearing bushing 22. A shaft 23 extends through and is rotatable in bushing 22 and is peripherally flatted at its top and bottom ends to form coupling sections 24 and 26 respectively of triangular transverse cross-section. Bottom coupling section 26 engages mating bracket bore 17 and is secured by set screw 174. A radially extending crank arm 27 having a triangular axial bore 28 engaging shaft coupling section 24 is fixed to the shaft by a set screw 29. A coupling pin 30 depends from the free end of crank arm 27.

Rotatably mounted on shaft 23 between crank arm 27 and bushing section 21 is a sector wheel 32 having a cylindrical peripheral face or channel 33 of about 180°. Wheel 32 terminates at one end in a radial wall 34 which bears on crank pin 30 and is provided at its opposite end with an end recess 36 across which is mounted a pin 37. A vertical transverse wall projects upwardly from base plate 19 between the ends thereof and includes a higher rear section 38 and a lower front section 39. A hydraulic linear motor 40 includes a longitudinally extending cylinder 41 having a peripherally flanged front end wall 42 bolted to wall section 38 and a rear end wall closing the outer end of cylinder 41.

A piston 43 is slidable in cylinder 41 and is provided with an axial piston rod 44 extending through cylinder end wall 42 and having proximate its outer end a peripheral groove 46. A U-shaped bracket 47 is mounted at the free end of piston rod 44 and supports between its legs a transverse pin 48. A chain link belt 49 has one end coupled to pin 48 and extends about the wheel peripheral face 33 and has its opposite end anchored to pin 37. A helical tension spring 50 has a first hooked end anchored to pin 37 and an opposite second hooked end anchored to wall section 39 to bias or tension belt 49. A normally open sensing switch SW1 includes an actuating arm 51 with a free end follower 52 bearing on piston rod 44 to close switch SW1 except when it engages groove 46 to raise arm 51 and open switch SW1.

Figure 8:
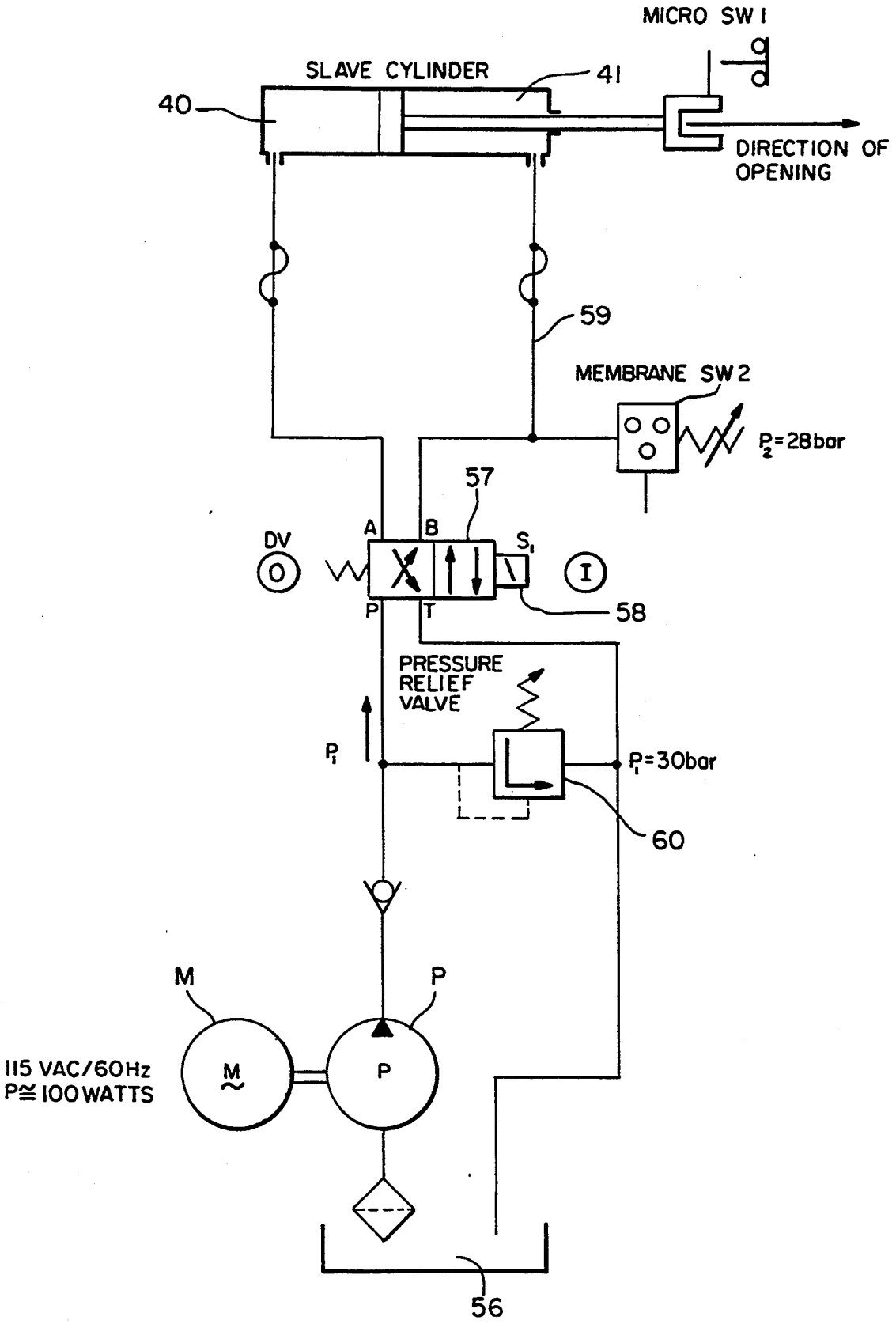
FIG. 8 is a schematic view of the door operating mechanism.

A hydraulic pressure pump P driven by an electric motor M (FIG. 8) has an inlet connected to a hydraulic fluid reservoir 56 and a pressure outlet connected to one inlet of a four way reversing valve 57 actuated by a solenoid 58 the other inlet discharging into reservoir 56. Each outlet of valve 57 is connected to a respective end interior of cylinder 41. Energization of solenoid 58 actuates valve 57 to connect the door opening advance end of cylinder 40 and the opening trailing end thereof to the outlet of pump P and to the reservoir 56 respectively and the deenergization of solenoid 58 reverses these connections.

An adjustable pressure responsive membrane switch SW2 is mounted in communication with the hydraulic fluid path, for example, pressure hose 59, between valve 57 and the inner piston advancing end of cylinder 41. Switch SW2 is normally closed and is open in response to the pressure on membrane switch exceeding, for example, 28 bar. An adjustable pressure responsive relief valve 60 has an inlet connected to the outlet of pump P and an outlet connected to reservoir 56 and responds to pressures exceeding the pressure response of switch SW2, for example a pressure of 30 bar, to open the valve.

Figure 9:
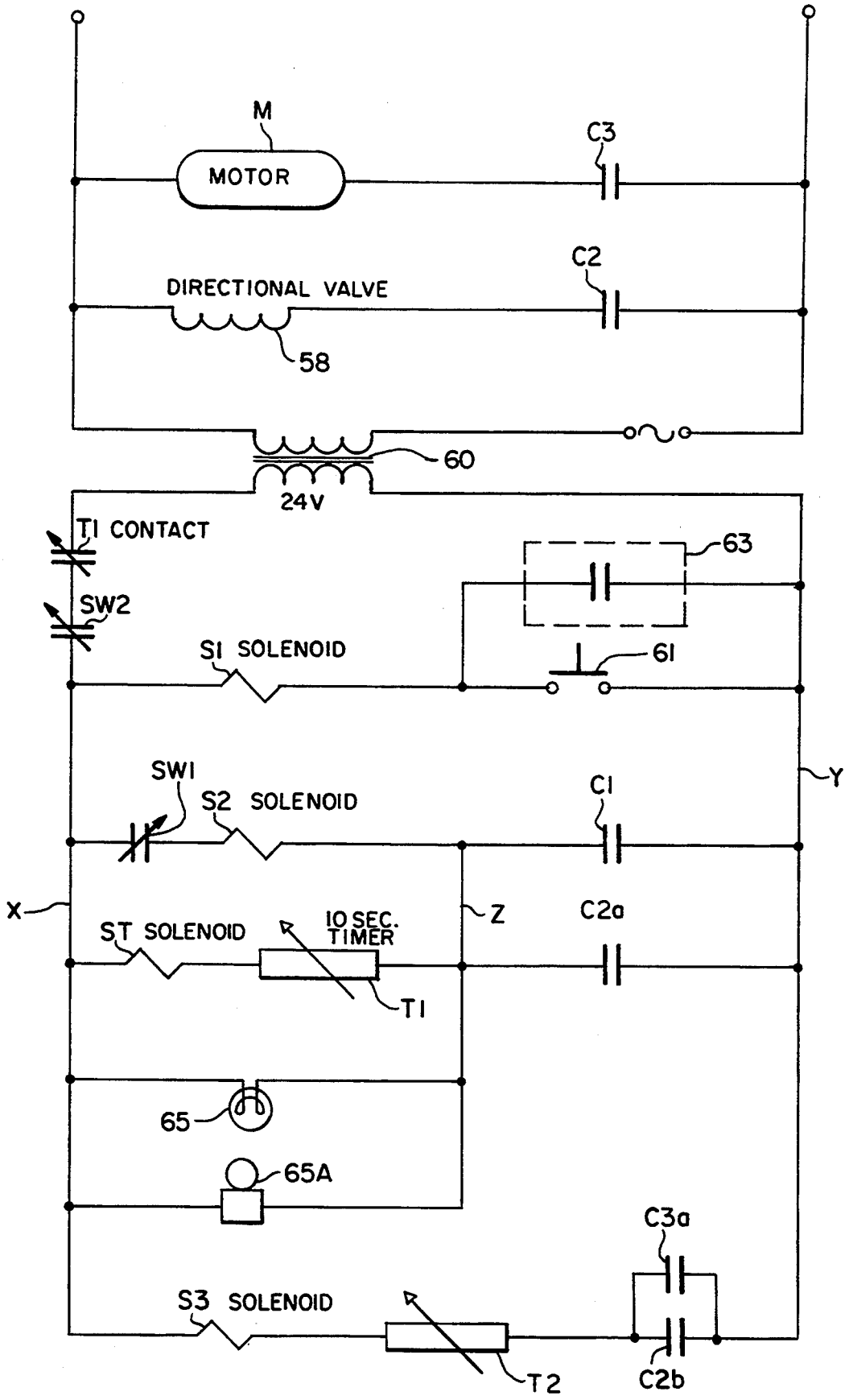
FIG. 9 is a schematic diagram of the circuit network forming part of the improved mechanism.

As illustrated in FIG. 9 which shows the electrical network associated with mechanism 10, the motor M is connected through normally open relay contacts C3 to an alternating current source, the valve solenoid 58 in series with normally open relay contacts C2 is connected to the current source and the primary of a step down transformer 60 is connected through a fuse to the alternating current source. One terminal of the secondary of transformer 60 is connected in series through normally closed timer relay contacts T and normally closed membrane pressure switch SW2 to a first conductor X and the other transformer secondary terminal is connected to a second conductor Y. A relay solenoid S1 actuating relay contacts C1 is connected through a normally open switch 61 which may be locally or remotely momentarily closed. An electrically actuated remote audible signal device is connected across switch 61. A third conductor Z is connected through parallel nominally open relay contacts C1 and **C2*a* to conductor Y the contacts being respectively actuated by relay solenoids S1 and S2**.

Connected between conductors X and Z are the series connected switch SW1 and relay solenoid S2, a solenoid ST in series with an adjustable current delay timer T1 of the order of 10 seconds, a strobe light 65 and a bell, or other electrically energized audible signal device **65*a*. A relay solenoid S3 actuating relay contacts C3 and C3*a* is connected in series with an adjustable current delay timer or a capacitor after about 3 seconds and in series with normally open relay contacts C2*b* and C3 a selfholding contact, actuated by solenoid S2** between conductors X and Y.

Considering the operation of the improved swinging door opening mechanism described above, the status of the electrical network during the standby closed condition of the swinging door is shown in FIG. 9 of the drawings. In the door closed condition motor M and valve solenoid S1 are deenergized with the piston advancing end of cylinder 41 communicating through valve 57 with oil reservoir 56. Upon the momentary closure of switch 61, solenoid S1 is momentarily energized to momentarily close contacts C2 and C1 to energize solenoid S2 through piston rod actuated switch SW1, which in turn closes relay contacts C2 and **C2*a*. The closure of relay contacts C2*a* holds conductor Z in energized condition to energize timer T1 for an adjustable period of about 10 seconds and visible and audible signaling devices 65 and 65*a* are energized. The solenoid S3, about 3 seconds following the closure of relay contacts C2*b*, closes relay contacts C3 to energize motor M. The valve solenoid 58 energized by the closure of relay contacts C2 switches valves 57 to connect the piston advancing end of cylinder 41 to the pressurized output of pump P and the opposite end to reservoir 56**.

Thus, about 3 seconds following the closure of switch 61 the motor M drives pump P to deliver pressurized fluid to the advancing end of piston 41 to apply an opening torque to door D by way of piston rod 44, belt 49, wheel abutment face 34, crank pin 30 and shaft 23. Also energized are sight and sound devices 65 and **65*a***.

Upon the full opening of door D switch SW1 is open upon piston rod groove 46 being engaged by switch rod 51 to open switch SW1, to thereby deenergize solenoid S2 to return relay contacts C2 to open and valve 57 to its initial rest door closed state. Relay contacts C3 are opened upon the opening of relay contacts C3 by deenergization of relay solenoid S3 with the opening of switch T1 contacts. Moreover, upon the energization of line Z with the closing of contacts C1, timer T is initiated, and after its set time interval, for example 10 seconds, solenoid ST1 is energized to open contacts T1 and deenergize line X, and return the control network to its initial rest position.

If during the opening of the door because of an impediment or back force restraining the opening of the door the torque applied to effect such opening exceeds a desired value, the hydraulic fluid pressure to which membrane switch SW2 is exposed exceeds a preadjusted response pressure, for example, 28 bars to effect the discontinuation of the application of the door opening torque in the same manner as the opening of switch T1 in the manner described. It should be noted that door 11 may be manually closed from any partially or fully open position upon return of the mechanism to its retracted door closed position by reason of the lost motion coupling between crank 27 and wheel sector face 34.

While there has been described and illustrated a preferred embodiment of the present invention, its is apparent that numerous alterations, omissions and additions may be made without departing from the spirit thereof.

I claim:

1. A swinging door opening mechanism comprising a door swingable about a vertical axis between an advanced door open position and a retracted closed position, means including a hydraulic motor drive for applying an open torque to said door, means including an electric motor drive pump for delivering a pressurized drive fluid to said hydraulic motor and fluid pressure actuated control means which in response to the pressure of said drive fluid delivered to said hydraulic motor exceeding a predetermined value interrupts the delivery of said pressurized drive fluid to said hydraulic drive motor.

2. The mechanism of claim 1 including means responsive to an input pulse signal for actuating said control means and for energizing said pump drive motor.

3. The mechanism of claim 1 wherein said fluid pressure actuated control means discontinues application of the door opening torque by interruption of the delivery of said pressurized drive fluid to said hydraulic drive motor in response to the pressure of said drive fluid delivered to said hydraulic drive motor exceeding a predetermined value.

4. The mechanism of claim 1 wherein said hydraulic motor has a drive input and said pump has a pressurized fluid output and input and a valve alternatively connecting said hydraulic motor input to said pump output or input, and said control means includes a solenoid responsive to said drive fluid pressure for actuating said valve to connect said hydraulic motor drive input through said valve alternatively to said pump input or output with the resulting deenergization and energization respectively of said pump.

5. The mechanism of claim 4 wherein said control means includes a switch responsive to said fluid pressure for alternatively energizing or deenergizing said valve solenoid.

6. The mechanism of claim 1 wherein said control means includes means responsive to said drive fluid pressure for one of either deenergizing or energizing said pump motor respectively with said fluid pressure respectively being one of either above or below a predetermined value.

7. The mechanism of claim 6 wherein said control means includes a switch responsive to said fluid pressure for alternatively energizing or deenergizing said pump motor.

8. The mechanism of claim 1 wherein said hydraulic motor includes a hydraulic cylinder having a piston movable between a retracted position and a door opened advanced position and said torque applying .means includes a linear to rotational motion translation coupling connecting said piston to said door.

9. The mechanism of claim 8 wherein said motion coupling includes a drive shaft affixed to said door at the axis of rotation thereof, a wheel rotatable on said shaft, a belt engaging said wheel and having one end connected to said shaft and a crank arm affixed to said shaft and rotatable therewith and having a follower member, said wheel having a radially spaced abutment located in the path of rotation of said follower member.

10. The mechanism of claim 8 wherein said control means includes a reversing valve having outlet first and second ports and inlet third and fourth ports, a solenoid actuating said valve to connect said first and second ports to said third and fourth ports or alternatively to said fourth and third ports respectively.

11. The mechanism of claim 8 including a switch actuated in response to the advanced position of said piston and said control means includes means for deenergizing said pump motor in response to the actuation of said switch.

12. A swinging door opening mechanism comprising a door swingable about a vertical axis between an advanced open position and a retracted closed position, means responsive to an input signal for applying to said door a torque in a door opening direction and fluid pressure actuated control means responsive to said door opening torque exceeding a predetermined value for discontinuing said application of said door opening torque.

13. The mechanism of claim 12 wherein said torque applying means includes a hydraulic motor drive coupled to said door and an electric motor driven hydraulic fluid pump having a pressurized fluid output connected to said hydraulic motor and said control means includes a switch actuated in responsive to the pressure of said pressurized fluid exceeding a predetermined value for deenergizing said electric motor.

14. The mechanism of claim 12 wherein said torque applying means includes a hydraulic motor drive coupled to said door and having a door advancing input port and an electric motor driven hydraulic pump having a pressurized fluid output and said control means includes a solenoid actuated valve alternatively connecting said hydraulic motor input port to said pump output or to discharge.

* * * * *